United States Patent [19]

Tondo

[11] Patent Number: 4,757,758

[45] Date of Patent: Jul. 19, 1988

[54] TRASH COMPACTOR WITH AN INCLINED RECEIVING CHAMBER

[75] Inventor: Frank Tondo, Allendale, N.J.

[73] Assignee: Arrow Steel Inc., Paterson, N.J.

[21] Appl. No.: 105,232

[22] Filed: Oct. 7, 1987

[51] Int. Cl.[4] ..... B30B 15/06

[52] U.S. Cl. ..... 100/245; 100/215; 100/218; 100/250

[58] Field of Search ..... 100/245, 179, 218, 215, 100/240, 188 R, 250, 195

[56] References Cited

U.S. PATENT DOCUMENTS

| | | | |
|---|---|---|---|
| 2,591,970 | 4/1952 | Seegers et al. . | |
| 2,649,945 | 8/1953 | McClellan . | |
| 3,253,537 | 5/1966 | Porter et al. . | |
| 3,521,553 | 5/1968 | Smolka et al. . | |
| 3,563,168 | 2/1971 | Doninger . | |
| 3,575,103 | 4/1971 | Charles . | |
| 3,603,247 | 9/1971 | Price . | |
| 3,604,345 | 9/1971 | Boje . | |
| 3,621,775 | 11/1971 | Dedio et al. . | |
| 3,625,139 | 12/1971 | Gollnick . | |
| 3,695,172 | 10/1972 | Cleary et al. . | |
| 3,802,337 | 4/1974 | St-Hiliare . | |
| 3,815,323 | 6/1974 | Longo . | |
| 3,913,474 | 10/1975 | Lewis . | |
| 3,937,139 | 2/1976 | Lendi | 100/215 |
| 4,099,457 | 7/1978 | Hyden . | |
| 4,134,335 | 1/1979 | O'Rourke et al. | 100/179 X |
| 4,188,873 | 2/1980 | Gattyan . | |
| 4,202,263 | 5/1980 | Schulte | 100/215 X |
| 4,603,626 | 8/1986 | Nall et al. | 100/215 |

OTHER PUBLICATIONS

Page 67–Sep. 1970, Solid Waste Management.

*Primary Examiner*—Andrew M. Falik

*Attorney, Agent, or Firm*—Banner, Birch, McKie and Beckett

[57] ABSTRACT

An extrusion-type trash compactor in which the trash receiving chamber is inclined downwardly towards an outlet opening at an angle of about forty-five degrees, and the outlet opening connects with the inlet of a compacting chamber that is disposed horizontally, whereby the overall length of the compactor is reduced to adapt the compactor for use in smaller trash rooms. The angle of the ram also functions to reduce blockages in the hopper by working the bottom of the accumulated pile of trash as it's moved relative thereto - which reduces the possibility of trash backing up into the chute leading into the hopper and thus reduces damage that may be caused by fire. The compacting chamber is also pivoted to the outlet opening of the receiving chamber to permit it to be opened for the purpose of clearing jams in the compacting chamber.

8 Claims, 1 Drawing Sheet

TRASH COMPACTOR WITH AN INCLINED RECEIVING CHAMBER

BACKGROUND OF THE INVENTION

The present invention relates to a trash compactor and particularly to an extrusion type compactor such as used, for example, in apartment buildings.

In multistory apartment buildings, for example, trash is often deposited in a chute that delivers it to a trash room on the ground floor from which it's collected. Not only is the loose trash unsightly and apt to have a foul odor, but handling it when its removed from the trash room is also time-consuming and therefore expensive—as well as unpleasant and exposes the operators to sanitary risks. Household trash also includes many items such as empty food cartons that are bulky and thus increase the volume of the trash which, in turn, tends to fill the trash room more quickly and to require larger trash rooms or more frequent handling to remove it.

Trash compactors not only significantly reduce the volume of the trash that must be handled, but also provide a convenient and effective means for introducing the trash into bags which are easier to store and handle, which confine any odors and which present less health risks.

One of the problems in installing trash compactors is that the trash rooms in existing buildings are limited in size and shape and often cannot accommodate trash compactors of convenient design. Applicant's co-pending application Ser. No. 8,362, filed Jan. 29, 1987, relates to an extrusion-type trash compactor having a compacting chamber arranged at an angle to the outlet opening of the trash receiving chamber, which arrangement reduces the overall dimensions of the unit and adapts it for use in smaller trash rooms or trash rooms that otherwise do not have a dimension large enough to receive a conventional_trash compactor in which the trash is extruded along the axis of the unit.

Another problem with conventional trash compactors is that they are subject to blockages, and clearing the blockages can be difficult and dangerous. For example, one way to release a blockage is the use of a de-jamming block, which is a large steel block that is inserted at the input of the compacting chamber. For this purpose the trash receiving chamber of the compactor is provided with an access opening through which the de-jamming block is introduced. The ram is then operated to force the block through the compacting chamber while the operator attempts to control the block and clear the blockage. This is inherently dangerous and can result in injuries.

Fire is also a problem in trash rooms. If a fire is started while the room contains a large amount of loose trash or if the trash has become blocked in the hopper leading into the trash receiving chamber and backs up to close the exit from the chute and thus accumulates in the chute, the fire can be severe since the chute acts as a chimney and also spreads the fire through the building. Moving the trash more quickly from the trash chamber and into a compacted mass and preventing blockages that would cause the trash to backup into the chute reduces the exposure to fire.

SUMMARY OF THE INVENTION

Accordingly, the objects of this invention are to provide a trash compactor that is adapted for use in smaller trash rooms, that reduces the risks of fire and blockages or jams and that, when its blocked or jammed, is easier and safer to clear.

In accordance with this invention, these objects are obtained by providing a trash receiving chamber that is inclined vertically downwardly to a compacting chamber with a horizontal discharge. Operating on an angle to the vertical, the horizontal component of the stroke of the ram is reduced relative to its actual stroke by the cosine of the angle of the incline while the actual length of the stroke remains adequate to provide a trash receiving chamber with an opening that is large enough to provide for free-fall of the trash into the trash receiving chamber in the path of the ram. Movement of the ram at an incline relative to the bottom of the accumulated trash in the hopper also tends to dislodge the trash in the hopper and to prevent blockages that would cause the trash to backup into the chute. At the same time, the compacting chamber is hinged to the outlet opening of the trash receiving chamber to provide for opening the compacting chamber in the event of a blockage so that it can be manually cleared, thus eliminating the need for access openings or the use of a de-jamming block and operating the ram for clearing the blockage.

DETAILED DESCRIPTION OF THE INVENTION

Figure 1:
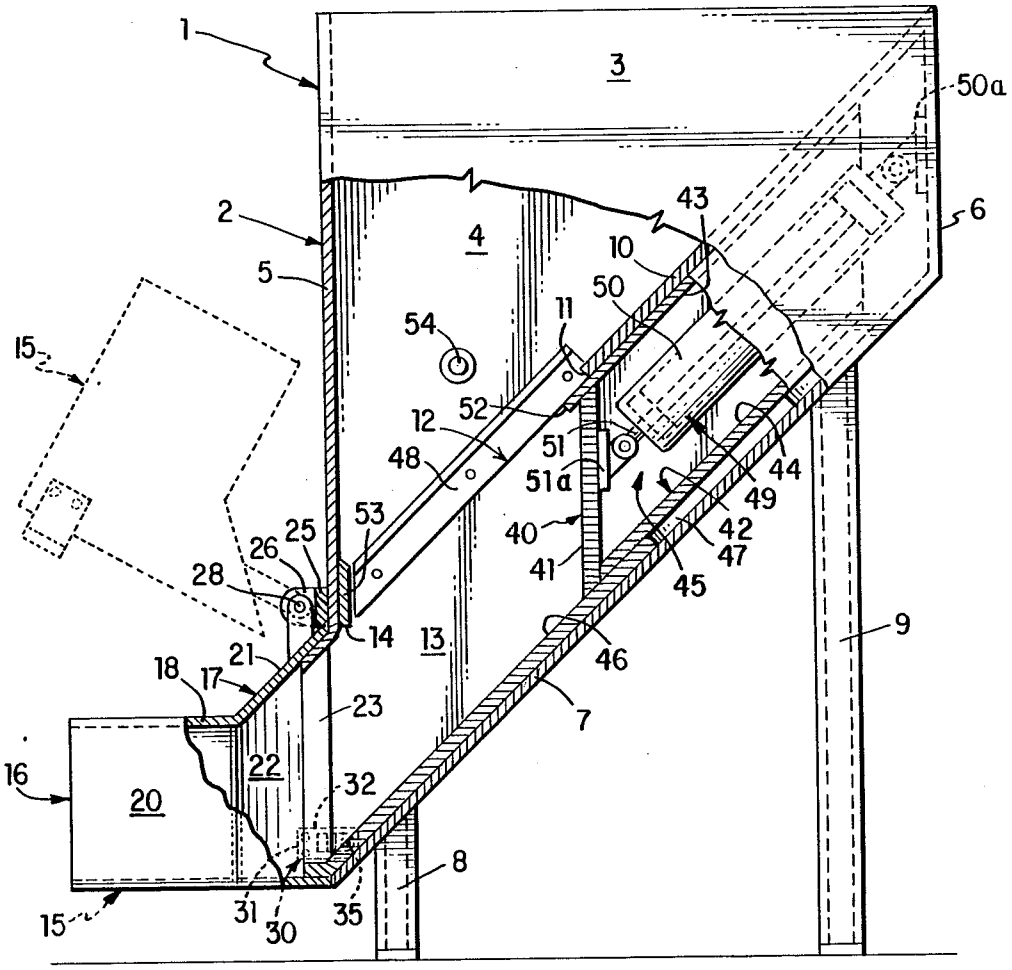
FIG. 1 is a side elevational view partly broken away of a trash compactor embodying the present invention.
Figure 2:
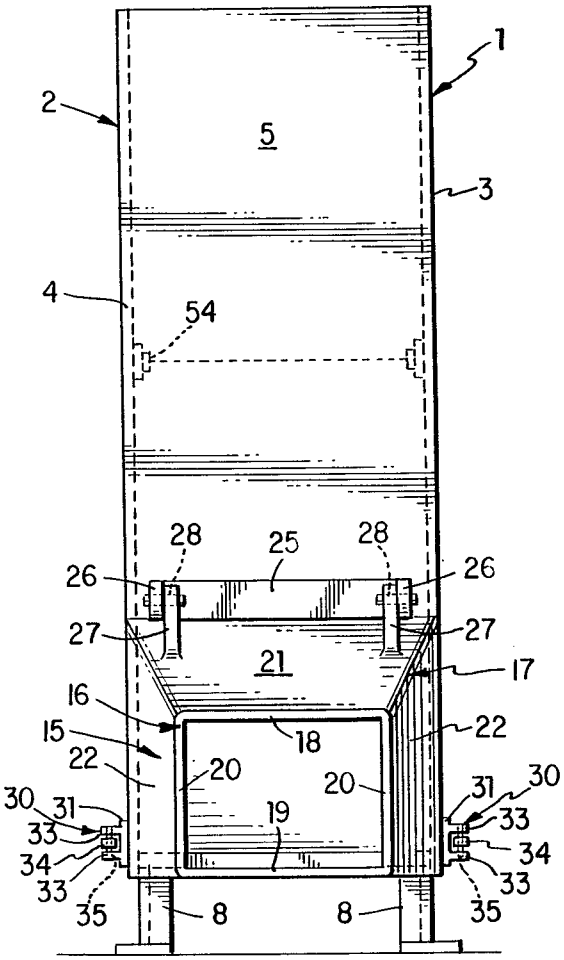
FIG. 2 is an end view of the trash compactor shown in FIG. 1.

With reference to the drawings, there is shown an extrusion-type trash compactor 1 having a hopper 2 that is substantially rectangular in horizontal cross-section and comprises opposed sidewalls 3 and 4 and a front endwall 5 and a rear endwall 6—the front endwall 5 being at the discharge end of the compactor 1.

The hopper 2 is open at the top to receive trash, for example, from the trash chute in an apartment building and is closed at the bottom by a bottomwall 7 that is inclined downwardly from the rear endwall 6 toward the front endwall 5 at an angle that, as shown, may be about forty-five degrees. The hopper 2 is supported on a pair of legs 8 at the front or discharge end of the compactor and a pair of legs 9 at the rear. Legs 8 and 9 are connected to the bottomwall 7 adjacent to the corners of the hopper.

Internally of the hopper 2 there is provided a transverse intermediate wall or baffle 10 that extends partially across the bottom portion of hopper 2 forwardly from the rear endwall 6. The baffle 10 is substantially parallel to and spaced upwardly from the bottom wall 7 and terminates in a front edge 11 spaced from the front endwall 5 to provide an inlet opening 12 from the hopper 2 into a trash receiving chamber 13 in the bottom of the hopper 2. An opening 14 is formed in the bottom of the endwall 5 at the discharge end of the receiving chamber 13 and defines the outlet opening for the receiving chamber 13.

A compacting chamber 15 is disposed outside the outlet opening 14 of the receiving chamber 13 and comprises an outlet end 16 and an inlet end 17. The outlet end 16 comprises an upperwall 18, a bottom wall 19 and a pair of sidewalls 20 defining a substantially rectangular cross-section that is less in height and width than the outlet opening 14. The inlet end 17 provides in effect a funnel leading from the outlet opening 14 of the receiving chamber 13 into the outlet end 16 and comprises upperwall 21 inclined upwardly from the rear edge of the upperwall 18 of the outlet end 16 to the upper edge of the outlet opening 14 and a pair of sidewalls 22 that are inclined outwardly from the rear edges of the sidewalls 20 of the outlet end 16 to the outer edges of the outlet opening 14 at the sidewalls 3 and 4.

The sidewalls 3 and 4, the front endwall 5 and the bottomwall 7 of the hopper 2 are provided with flanges 23 to provide a mouth leading into the inlet end 17 of the compacting chamber the flanges 23 being bent to conform to the angle of the sidewalls 22, upperwall 21 and bottomwall 19 of the inlet end 17 of the compacting chamber.

The compacting chamber 15 is pivotably mounted on the front endwall 5 by a bar 25 secured to the front endwall 5 as by welding and having a forwardly extending lug 26 at each end to which an arm 27 is pivotably connected by a pivot pin 28. The free ends of the arms 27 are secured as by welding to the upperwall 21 of the inlet end 17 of the compacting chamber.

A pair of quick-release latches 30 lock the compacting chamber 15 in its closed position. Each of the latches 30 comprises a bracket 31 secured as by welding to a sidewall 22 of the inlet end 17 of the compacting chamber 15 at a point remote from the pivot point defined by the pivot pins 28 and a cooperating bracket 32 secured to the sidewalls 3 and 4 of the hopper. Each bracket 31 has a pair of lugs 33 between which a lug 34 on the bracket 32 is disposed, the lugs each having a hole through which a pin 35 is adapted to be dropped to lock the lugs against separation. When the pins 35 are removed, the compacting chamber 15 is adapted to be swung about the pivot pins 28 to open the input end of the compacting chamber to provide for clearing a blockage.

Trash deposited in the hopper 2 is directed by the incline of the baffle 10 into the inlet opening 12 of the receiving chamber 13 and is adapted to be forced from the receiving chamber toward the outlet opening 14 and into the compacting chamber 15 by a ram 40 having a trash engaging face 41 and a skirt 42 extending from the periphery of the face 41 in the direction away from the outlet opening 14. The skirt 42 includes a topwall 43, a bottomwall 44 and a pair of opposed sidewalls 45 that together define a cross-section normal to the center line thereof that is substantially rectangular and is dimensioned to be received within the receiving chamber 13 for sliding movement endwise thereof while substantially filling the receiving chamber.

The ram 40 is adapted to ride on a reinforcing and wear plate 46 overlying the bottomwall 7 of the hopper beneath the receiving chamber 13 and having arms 47 extending beneath the baffle 10 along the sidewalls 3 and 4 to hold the ram level as it's moved out of the receiving chamber 13 and beneath the baffle 10. The ram is held down against the plate 46—or in other words, it's kept from riding upwardly on the trash as it's advanced through the receiving chamber 13—by a pair of bars 48 secured to the sidewalls 3 and 4 with the bottom edges thereof on lines comprising smooth continuation of the bottom face of the baffle 10.

The ram 40 is adapted for linear movement longitudinally of the receiving chamber 13 by a hydraulic piston 49 disposed within the skirt 42 of the ram on an axis substantially coinciding with the longitudinal axis of the ram. The piston 49 has a cylinder 50 pivoted to a bracket **50*a* that is secured at one end to the rear endwall 6 of the hopper and a piston rod 51 pivoted to a bracket 51*a* secured to the inside of the trash engaging face 41 of the ram 40. Ram 40 also includes a cutting edge 52 formed by the leading edge of the upperwall 43 of the skirt 42 which extends forwardly of the trash engaging face 41 at the top thereof and is adapted to cooperate with a ledger blade 53 secured to the inside of the frontwall 5 on the top edge of the outlet opening 14**.

A photocell 54 is provided in the hopper immediately above the inlet opening 12 to the receiving chamber 13 to actuate the hydraulic piston 49 when the trash in the hopper accumulates to that level.

The trash engaging face 41 of the ram 40 is disposed parallel to the front endwall 5 at the outlet end of the compactor which, as shown, is vertical—or, stated differently, the trash engaging face 41 is angled relative to the longitudinal axis of the receiving chamber 13 at an angle that is the complement of the angle of inclination of the longitudinal axis relative axis relative to the horizontal. Accordingly, with a horizontal discharge from the receiving chamber 13 into the compacting chamber 15 and an inclined ram 40, the trash engaging face 41 fills the outlet opening 14 of the receiving chamber 13 when it reaches the bottom of the stroke. This, in affect, provides an active trash-engaging face that exerts pressure over the entire area of the outlet opening 14 and in a direction axially of the longitudinal axis of the compacting chamber 15.

Movement of the ram 40 at an angle relative to the trash in the hopper 2 causes the ram to engage—or to brush against—the bottom of the pile of trash in hopper 2 in a manner that tends to dislodge it and to cause it to fall into the receiving chamber 13, thus helping to prevent blockages from forming in the hopper by making it more difficult for the trash to bridge the inlet opening 12 of the receiving chamber 13. The fact that three of the walls leading into the receiving chamber 13—that is, the sidewalls 3 and 4 and the front endwall 5—are vertical and that the baffle 10 is the only sloping wall into the receiving chamber also makes it difficult for the trash to bridge the inlet opening 12. Reducing blockages in the hopper also reduces backup of trash in the chutes leading into the hopper, which in turn reduces fire hazards by reducing the amount of loose trash as well as by confining the trash to the trash room and keeping it out of the chute, which can function as a chimney.

In operation, trash deposited in the hopper 2 falls either directly through the inlet opening 12 into the receiving chamber 13 or on and sides down the baffle 10 toward inlet opening 12 into the receiving chamber 13. When the accumulation of trash reaches the level of the photocell 54, movement of the ram 40 is initiated. As the ram 40 advances, the face 41 engages the trash in the receiving chamber and forces it toward the outlet opening 14 while the topwall 43 of the skirt 42 closes the inlet opening 12 and, as mentioned above, tends to prevent the trash from bridging the inlet opening 12 and thus to prevent the formation of blockages.

As the trash moves through the inlet end 17 of the compacting chamber 15, which has a decreasing cross-section, and changes direction from the inclined axis of the receiving chamber 13 to the horizontal axis of the compacting chamber 15, there is increasing resistance to the flow of the trash. The trash is thus compacted against the previously compacted trash and, with suitable force is extruded at the outlet end 16 as a compacted mass. In the usual manner the compacted material can be extruded directly into a sausage type trash bag, for example, and onto a conveyor, or can otherwise be collected to be disposed of.

Upon completion of the forward stroke of the ram 40, it is reversed as, for example, by a limit switch and returned to its original position under the baffle 10 with the inlet opening 12 of the receiving chamber 13 again open to receive trash—the ram again brushing against the bottom of the pile of trash in the hopper to dislodge it.

With a piston having a given stroke, there is with this invention a reduction in the overall length of the compactor. More particularly, the stroke of the piston 49 along the axis of the receiving chamber 13 has a horizontal component that is equal to the cosine of the angle at which the receiving chamber is inclined relative to the horizontal, thus reducing the overall length of the compactor and adapting it for use in smaller trash rooms. The stroke of the piston also of course determines the size of the inlet opening 12 into the receiving chamber 13 which must be large enough to provide for free-fall of the trash from the hopper 2 through the inlet opening 12 into the receiving chamber 13.

Modifications to the invention as herein disclosed will be obvious to those skilled in the art.

Having thus described the invention what we claim is:

1. A trash compactor comprising a receiving chamber of substantially uniform cross-section, means for supporting said receiving chamber with its longitudinal axis inclined downwardly at an angle relative to the horizontal, said receiving chamber having an inlet opening in the top thereof for receiving trash to be compacted and an outlet opening on the lower end thereof, said outlet opening being disposed in a substantially vertical plane and thereby inclined relative to the longitudinal axis of the receiving chamber at an angle relative to the vertical that is the complement of said first-mentioned angle, an upwardly-open hopper disposed over the inlet opening of said receiving chamber for receiving trash and for delivering the same into said receiving chamber, a ram mounted for linear movement longitudinally of said receiving chamber toward and away from said outlet opening, said ram having a trash engaging face corresponding dimensionally with and disposed parallel to the plane of said outlet opening, a skirt extending from the periphery of and substantially parallel to the longitudinal axis of said receiving chamber for closing and opening said inlet opening as said ram is moved toward and away from said outlet opening, means for imparting linear movement to said ram, and a compacting chamber having an inlet end for receiving trash through said outlet opening and an outlet end substantially on a horizontal axis in a vertical plane through the axis of the receiving chamber.

2. A trash compactor in accordance with claim 1 in which said outlet end of said compacting chamber is of substantially uniform cross-section that is reduced relative to the cross-section of said receiving chamber, and said inlet end connects said outlet and to said outlet opening of said receiving chamber.

3. A trash compactor in accordance with claim 1 in which said hopper and said receiving chamber have common sidewalls and front endwall, and said hopper includes a baffle overlying said ram when in the retracted position for directing trash toward said inlet opening of said receiving chamber.

4. A trash compactor in accordance with claim 3 in which said baffle is inclined downwardly from a rear endwall of said hopper towards said receiving chamber at an angle to the horizontal equal to said first mentioned angle.

5. A trash compactor in accordance with claim 4 in which said means for imparting linear movement to said ram comprises a cylinder connected at one end to said rear endwall and a piston rod connected to said ram and cooperating with said cylinder, said cylinder being disposed with the longitudinal axis thereof substantially aligned with the longitudinal axis of said receiving chamber.

6. A trash compactor in accordance with claim 1 in which said first mentioned angle is approximately forty-five degrees.

7. The trash compactor in accordance with claim 1 including connecting means for removably connecting said compacting chamber to said receiving chamber and for providing for release of said compacting chamber to clear blockages.

8. A trash compactor in accordance with claim 7 in which said connecting means provides for pivotal movement of said compacting chamber away from said outlet opening, and means for releasably securing said compacting chamber in its closed position relative to said outlet opening.

* * * * *